US007326124B1

(12) United States Patent
Fairbanks

(10) Patent No.: US 7,326,124 B1
(45) Date of Patent: Feb. 5, 2008

(54) GOLF SWING TRAINER

(76) Inventor: Scott D. Fairbanks, 1149 N. 1080 West, Orem, UT (US) 84057

( * ) Notice: Subject to any disclaimer, the term of this patent is extended or adjusted under 35 U.S.C. 154(b) by 0 days.

(21) Appl. No.: 11/501,502

(22) Filed: Aug. 8, 2006

(51) Int. Cl.
*A63B 69/36* (2006.01)

(52) U.S. Cl. ..... 473/256; 473/257

(58) Field of Classification Search ..... 473/219, 473/226, 227, 229, 256, 257, 266, 269
See application file for complete search history.

(56) References Cited

U.S. PATENT DOCUMENTS 1,222,563 A * 4/1917 Rosenberg ..... 5/419
1,471,794 A 10/1923 Leven
1,662,712 A 3/1928 Mensing
1,930,342 A 10/1933 Graham
2,968,825 A * 1/1961 Wetherby ..... 15/118
3,428,325 A 2/1969 Atkinson
4,195,378 A * 4/1980 Parker ..... 5/419
4,343,473 A 8/1982 Laursen
4,982,963 A 1/1991 Fazio et al.
5,286,019 A * 2/1994 Watabe ..... 473/282
5,316,306 A 5/1994 Cody
5,361,435 A * 11/1994 Reeves ..... 5/419
5,918,341 A * 7/1999 Hale ..... 15/209.1
6,182,309 B1 * 2/2001 Sullivan ..... 5/419
6,839,921 B2 * 1/2005 Cloutier et al. ..... 5/417
6,952,845 B1 * 10/2005 Akkad ..... 5/419

* cited by examiner

*Primary Examiner*—Nini F. Legesse
(74) *Attorney, Agent, or Firm*—Angus C. Fox, III

(57) ABSTRACT

A golf swing trainer including a towel folded parallel to its longitudinal edges to form a flaccid multi-layer strip which simulates the handle and shaft of a golf club; a tubular member; a flexible strap which interconnects the bottom edge of the strip and said tubular member; and at least one insert which is split axially and longitudinally into two half inserts, each half insert having a longitudinal groove so that the flexible strap can be trapped between the two half inserts when the grooves are mutually aligned and the two half inserts are brought together in intimate contact, said at least one insert being individually installable within said tubular member to adjust said weight to a desired value. The tubular member, alone or in combination with an insert, simulates the head of a golf club.

17 Claims, 7 Drawing Sheets

GOLF SWING TRAINER

FIELD OF THE INVENTION

This invention relates, generally, to golf swing training devices and, more particularly, to golf swing training devices having a flaccid member which substitutes for the shaft of a golf club.

BACKGROUND OF THE INVENTION

Golf is an increasingly popular outdoor game that may be played by persons of all ages using long-shafted clubs and a small ball on a large, grassy outdoor expanse called a course. Each golfer tries to hit the ball from the starting area called a tee into a small, sunken cup generally located on a green that is between 100 to 600 yards from the tee with as few strokes as possible. A typical golf course consists of 9 or 18 playing areas called holes, each of which is assigned a value called par, which is the average number of strokes an expert player would require to play the hole. For strokes or shots used to reach the green, the ball is typically hit with a driver club or iron club into the air. Upon reaching the green, the ball is typically hit with a putter club so that it travels entirely by rolling on the ground.

Putts and short chips (a short and low approach shot where the ball makes a shallow flight and then rolls out on the green) are ideally played without much movement of the body, but most other golf shots are played using variants of a full golf swing. The full golf swing is notoriously difficult to learn, and involves an unnatural, highly complex rotation of the body, the objective of which is to accelerate the club head so as to achieve maximum speed at the bottom of the stroke as the ball is struck. It is not uncommon for beginners to spend several months practicing the swing basics before playing their first ball on a course. It is generally considered impossible to acquire a stable and successful swing without professional instruction and even highly skilled golfers may continue to take golf lessons for many years. For a right-handed golfer, the full swing consists of a backswing to the right, a downswing to the left (in which the ball is hit), and a follow through. At address, the player stands with the left shoulder and hip pointing in the intended direction of ball flight, with the ball before the feet. The club is held with both hands (right below left for right-handed players), the club-head resting on the ground behind the ball, hips and knees somewhat flexed, and the arms hanging from the shoulders. The backswing is a rotation to the right, consisting of a shifting of the player's body weight to the right side, a turning of the pelvis and shoulders, lifting of the arms and flexing of the elbows and wrists. At the end of the backswing the hands are above the right shoulder, with the club pointing more or less in the intended direction of ball flight. The downswing is roughly a backswing reversed. After the ball is hit, the follow-through stage consists of a continued rotation to the left. At the end of the swing, the weight has shifted almost entirely to the left foot, the body is fully turned to the left and the hands are above the left shoulder with the club hanging down over the players' back. Relatively few golfers play left-handed (i.e., swing back to the left and forward to the right), with even players who are strongly left-handed in their daily life preferring the right-handed golf swing. (*Wikipedia*, article about golf, updated Aug. 1, 2006)

Given the difficulty of mastering the full golf swing, it is not surprising that a plethora of golf swing trainers have been developed over the years. U.S. Pat. No. 1,471,794 to Charles Leven discloses a practice golf club having a head connected via a toothed shaft to a coil spring. As the head is driven away from the handle when subjected to centripetal force, a spring-loaded pawl locks the toothed shaft in its most extended position, thereby providing an indication of the rotational speed of the club. U.S. Pat. No. 1,662,712 to Carl F. Mensing discloses a golf club having a flexible, whip-like shaft which compels the user to swing smoothly and thereby improve his swing. U.S. Pat. No. 1,930,342 to Mack C. Graham discloses a Golf Practice Club which combines a conventional club shaft and handle with an adjustable weight that is connected to the bottom end of the shaft with a chain, a wire or other flexible element. The loosely-coupled weight will jerk the shaft if the downswing is begun prematurely. U.S. Pat. No. 3,428,325 to Garland P. Atkinson discloses a Golf Swing Training Device having a rigid handle and a padded weight coupled to the bottom end of the handle with a flexible elastic cord. The training device assists in the development of a proper swing by allowing a right-handed user to feel the padded weight strike him in the left chest or shoulder during the backswing and in the right chest or shoulder at the end of the followthrough. In addition, proper timing of the swing is encouraged if the weight smoothly follows the arc of the shaft. U.S. Pat. No. 4,343,473 to Paul D. Laursen discloses a Golf Swing Trainer having a rigid hand grip connected at the bottom end thereof to a shaft formed of a limp, flexible material such as nylon rope. The free end of the shaft is unravelled to form a soft tassel. The swing trainer encourages the user to use his entire body during the downswing so that the flexible shaft can be pulled through the ball impact region. U.S. Pat. No. 4,982,963 to Jerry J. Fazio, et al. discloses a Golf Club Swing Training Device having a laterally curvable shaft made of an elastomeric material such as neoprene rubber, with a head member made of resilient material attached to the end of the shaft. The device is designed to give the user an improved feel for the swing, and retains the advantage that the device cannot be swung property unless all the various aspects of the swinging of the golf club are properly coordinated. U.S. Pat. No. 5,316,306 to Douglas R. Cody discloses a Golf Swing Training Device having a rigid had grip connected to one end of a flexible tubular shaft.

SUMMARY OF THE INVENTION

A golf swing trainer including a towel folded parallel to its longitudinal edges to form a flaccid multi-layer strip which simulates the handle and shaft of a golf club; a tubular member; a flexible strap which interconnects the bottom edge of the strip and said tubular member; and at least one insert which is split axially and longitudinally into two half inserts, each half insert having a longitudinal groove so that the flexible strap can be trapped between the two half inserts when the grooves are mutually aligned and the two half inserts are brought together in intimate contact, said at least one insert being individually installable within said tubular member to adjust said weight to a desired value. The tubular member, alone or in combination with an insert, simulates the head of a golf club.

PREFERRED EMBODIMENT OF THE INVENTION

The various embodiments of the invention will now be described in detail with reference to the attached drawing figures. It is to be understood that the drawings are not necessarily drawn to scale and that they are intended to be merely illustrative.

Figure 1:
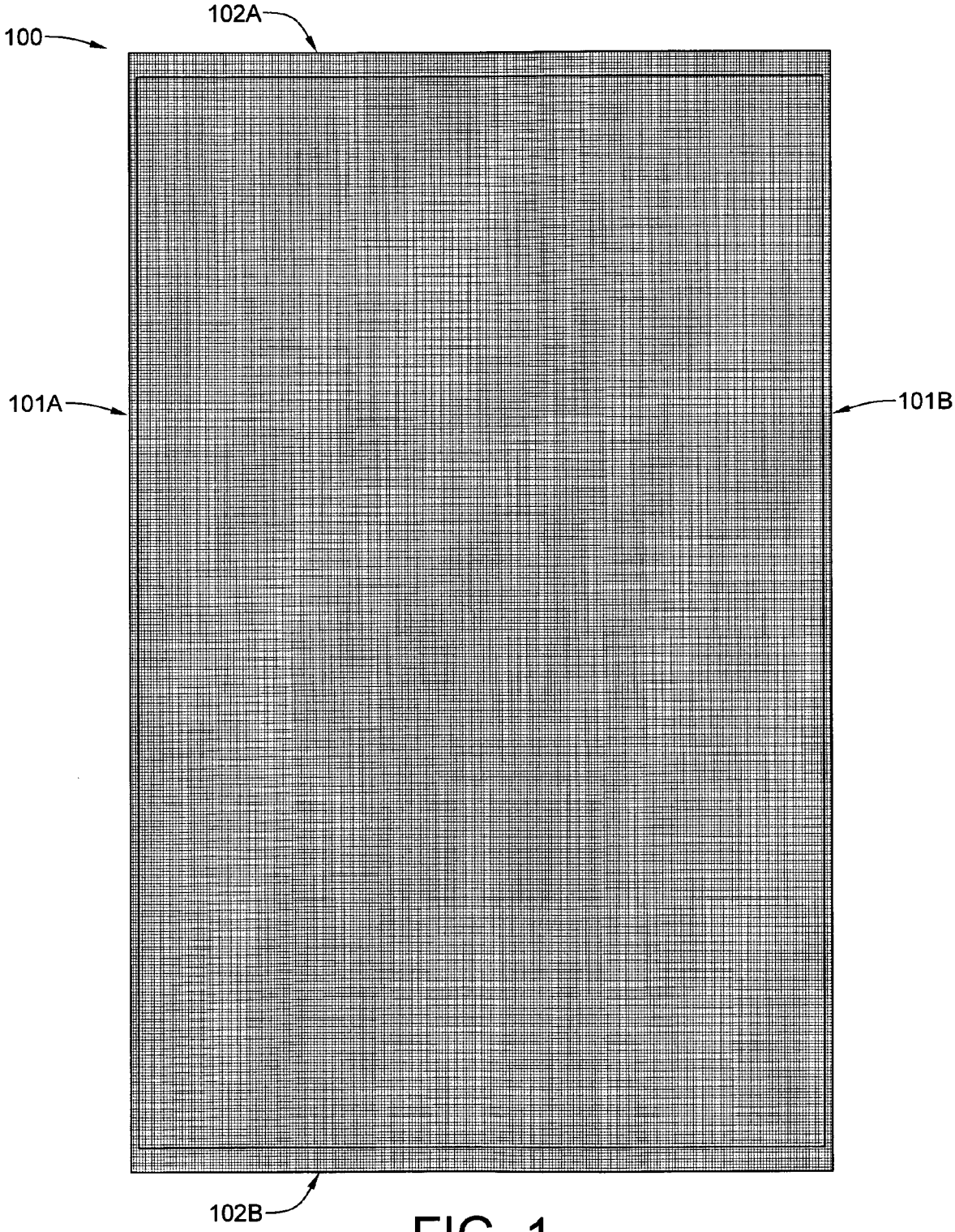
FIG. 1 is a top plan view of a terry cloth cotton towel.

Referring now to FIG. 1, a terry cotton towel 100 having longitudinal edges 101A and 101B and lateral edges 102A and 102B is shown in an unfolded planar configuration.

Figure 2:
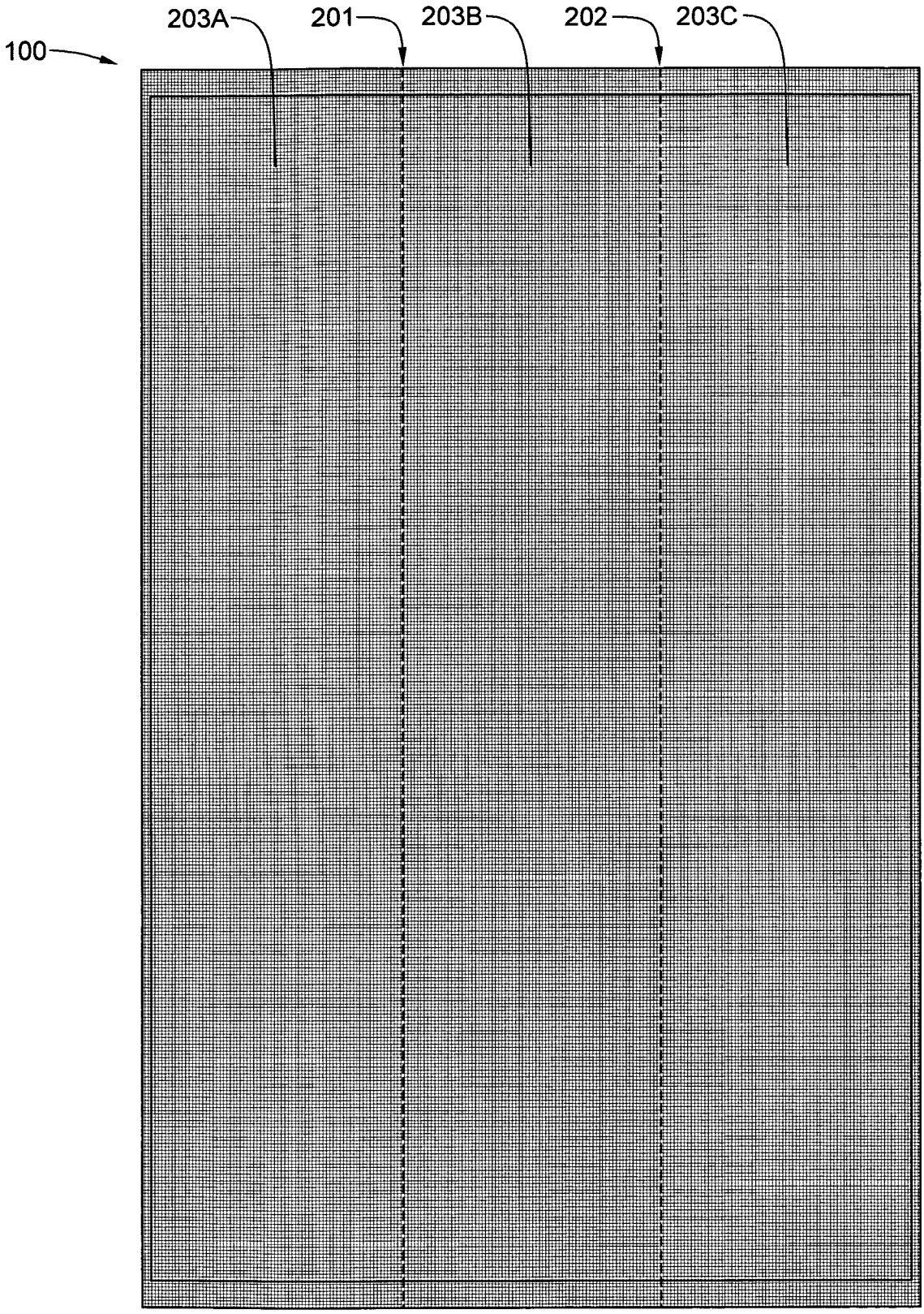
FIG. 2 is a top plan view of the terry cloth cotton towel of FIG. 1 showing a pair of dashed lines where the towel will be folded.

Referring now to FIG. 2, the terry cotton towel 100 of FIG. 1 has been marked with two dashed lines 201 and 202 which are the approximate fold lines for the preferred embodiment of the invention. The towel 100 is thus divided into a left third 203A, a middle third 203B and a right third 203C.

Figure 3:
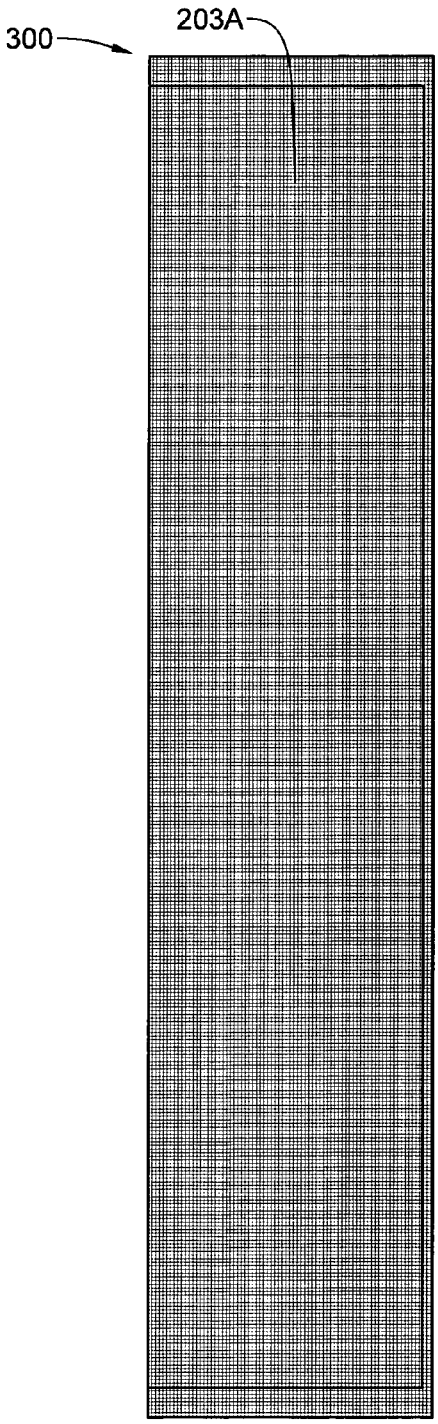
FIG. 3 is a top plan view of the terry cloth cotton towel of FIG. 2 after the right third thereof is folded over the middle third and the left third is folded over the right third.

Referring now to FIG. 3, the terry cotton towel 100 of FIG. 1 has been folded in thirds, with the right third 203C being folded over the middle third 203B, and the left third 203A being folded over the right third 203C. A flaccid, three layer towel strip 300 having the same length and about one-third the width of the original towel 100 has, thus, been formed.

Figure 4:
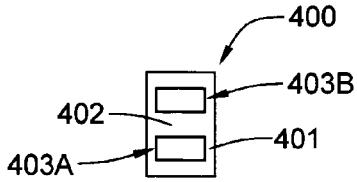
FIG. 4 is a top plan view of a square eight retainer plate.

Referring now to FIG. 4, a retainer plate 400 has a square eight shape which includes a perimetric border 401 that is spanned by a central bar 402, resulting in two spaced-apart apertures 403A and 403B.

Figure 5:
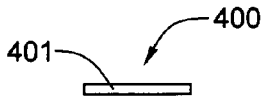
FIG. 5 is a side elevational view of the retainer plate of FIG. 4.

Referring now to FIG. 5, the retainer plate 400 is seen in a side, wherein only a portion of the perimetric border 401 is visible.

Figure 6:
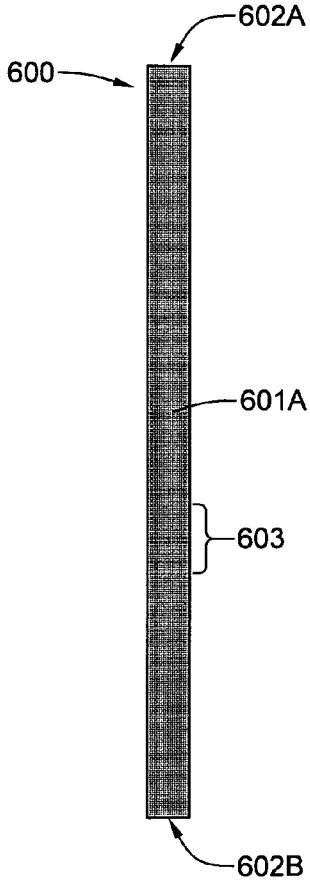
FIG. 6 is a top plan view of a woven nylon strap.

Referring now to FIG. 6, a first major surface 601A of a flexible woven nylon strap 600 is shown. The strap 600 has a first end 602A and a second end 602B. An opposed second major surface 601B, which is not visible in this view, is beneath the first major 601A. A region 603 spaced from the second end 602B will be referred to while describing FIG. 7.

Figure 7:
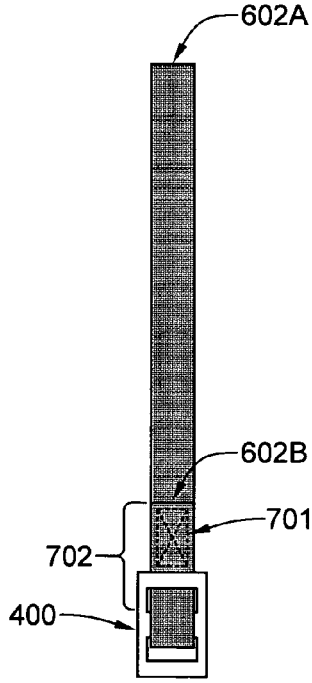
FIG. 7 is a top plan view of the woven nylon strap of FIG. 6 after the end thereof has been wrapped around the center rung of the retainer plate and sewn to a more central portion of the strap with a rectangle and X stitch.

Referring now to FIG. 7, the second end 602B of the flexible woven nylon strap 600 has been looped around the center bar 402 of the retainer plate 400 and sewn with a first rectangle and X stitch 701 to region 603 that is identified in FIG. 6, resulting in a double thickness region 702 of the strap 600.

Figure 8:
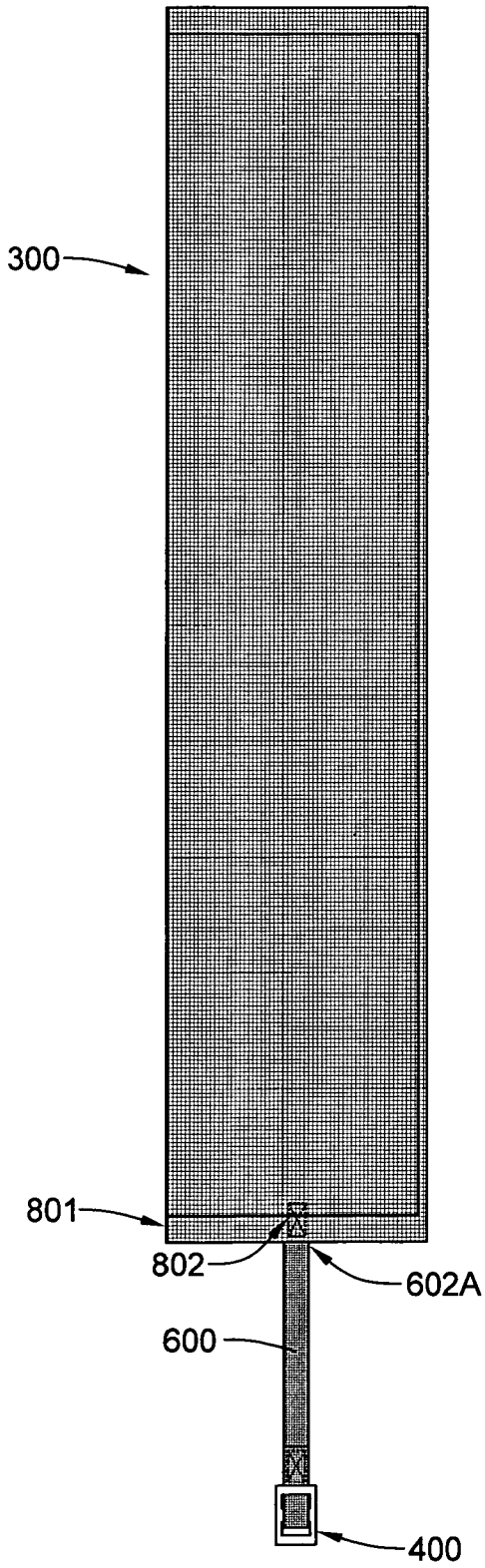
FIG. 8 is a top plan view of the folded terry cloth cotton towel of FIG. 3 after the free end of the woven nylon strap and attached retainer plate of FIG. 7 are sewn to the bottom edge.

Referring now to FIG. 8, the first end 602A of the flexible woven nylon strap 600 with the retainer plate attached to the second end thereof 602B has been sewn to the bottom edge 801 of the towel strip 300 with a second rectangle and X stitch 802. In addition to securing the first end 602A of the flexible nylon strap 600 to the towel strip 300, the second rectangle and X stitch 802 also to hold together the three folded layers of the towel strip 300.

Figure 9:
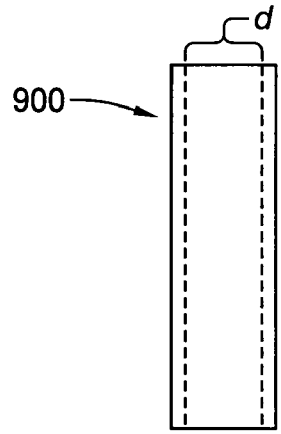
FIG. 9 is a side elevational see-through view of a metal pipe section core.

Referring now to FIG. 9, a first embodiment tubular member 900, which can be a section of cast iron pipe, is shown in a see-through view. The first embodiment tubular member 900 has an inner diameter d.

Figure 10:
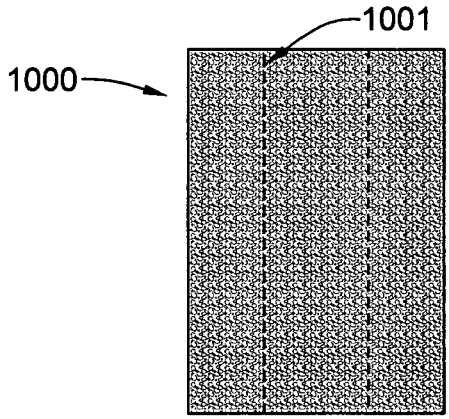
FIG. 10 is a side elevational view of a cylindrical foam pad having a cylindrical center aperture.

Referring now to FIG. 10, a cylindrical foam pad 1000 having a cylindrical center aperture 1001 is shown.

Figure 11:
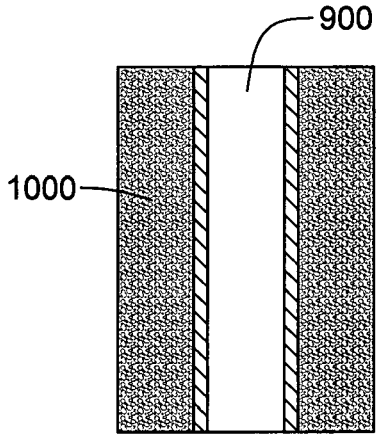
FIG. 11 is a cross-sectional view of an assembly consisting of the metal pipe section of FIG. 9 installed in the cylindrical center aperture of the cylindrical foam pad of FIG. 10, taken through the central axis of the assembly.

Referring now to FIG. 11, the first embodiment tubular member 900 has been inserted within the cylindrical center aperture 1001 of the cylindrical foam pad 1000. The cylindrical center aperture 1001 is of slightly smaller diameter than the outer diameter of the first embodiment tubular member, resulting in an interference fit. This assembly 1100, consisting of the first embodiment tubular member 900 and the cylindrical foam pad 1000, will simulate the head of a golf club for the golf swing trainer.

Figure 12:
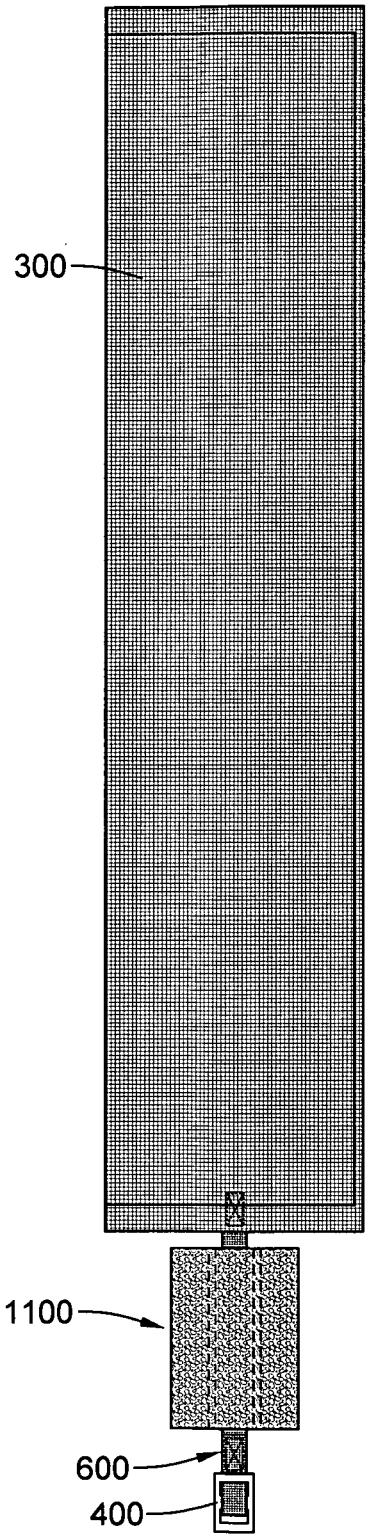
FIG. 12 is a side elevational view of the folded terry cloth cotton towel and attached strap of FIG. 8 after the assembly of FIG. 11 has been slid over the retainer plate and strap.

Referring now to FIG. 12, with the retainer plate 400 rotated so that it is generally parallel the major surfaces 601A and 601B of the flexible nylon strap 600, the tubular member 900 of assembly 1100 of FIG. 11 is slipped over the retainer plate 400 and onto the flexible nylon strap 600.

Figure 13:
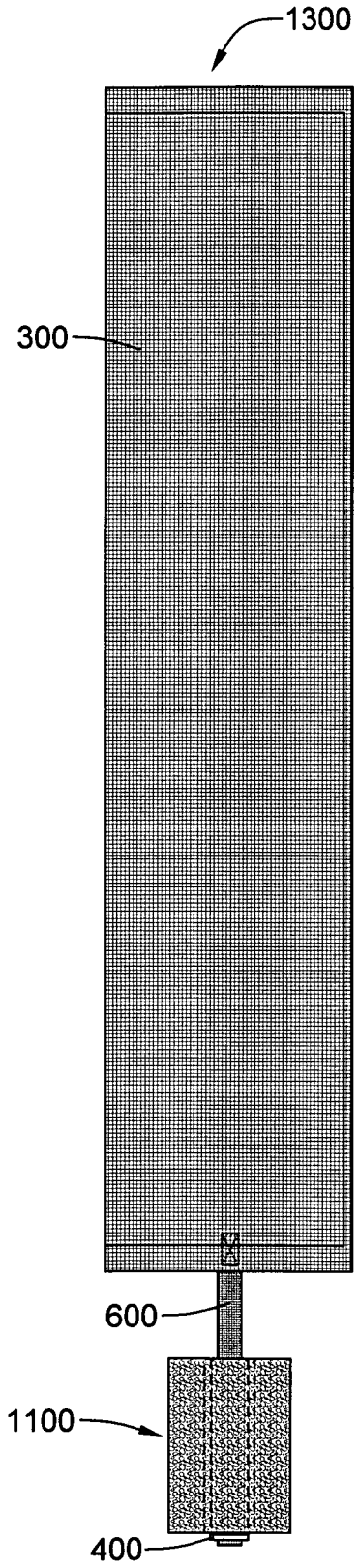
FIG. 13 is a side elevational view of the fully assembled golf swing trainer after the pipe and pad assembly has been slid down the strap to rest on the retainer plate.

Referring now to FIG. 13, the retainer plate 400 has been rotated so that it is generally perpendicular to the major surfaces 601A and 601B of the flexible nylon strap 600, and the assembly 1100 has been slid down the strap so that the tubular member 900 contacts the retainer plate 400. A first embodiment golf swing trainer 1300 is now complete.

Figure 14:
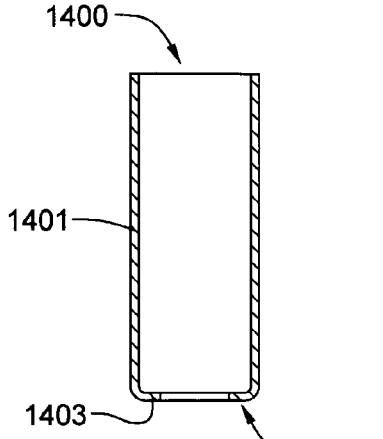
FIG. 14 is a cross-sectional view of an alternative embodiment tubular member.

Referring now to FIG. 14, a second embodiment tubular member 1400 has a cylindrical wall 1401 and a formed lower end 1402 made of sheet metal that is of generally lighter gauge than the metal from which the first embodiment tubular member 900 is made. In addition, the outer and inner diameters of the cylindrical wall are both larger than the corresponding diameters of the first embodiment tubular member 900. In addition, the second embodiment tubular member 1400 has a formed lower end 1401 and an annular restriction 1403 which reduces the diameter d of the opening to about the size of the inner diameter of the first embodiment tubular member 900.

Figure 15:
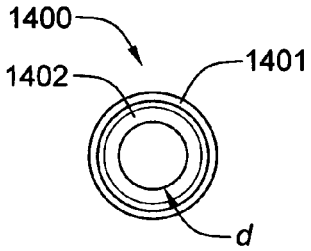
FIG. 15 is a top plan view of the tubular metal core of FIG. 14.

Referring now to FIG. 15, this top view of the second embodiment tubular member 1400 clearly shows the annular restriction 1402.

Figure 16:
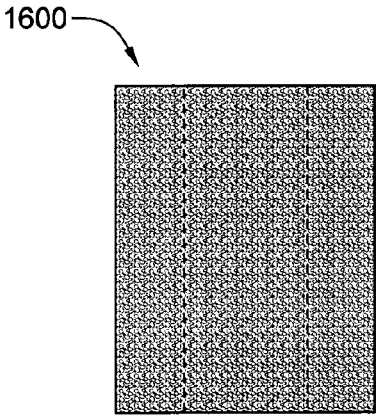
FIG. 16 is an alternative cylindrical foam pad sized to fit the tubular member of FIGS. 14 and 15.

Referring now to FIG. 16, a second embodiment cylindrical foam pad 1600 is sized to fit the second embodiment tubular member 1400 with an interference fit that is sufficient to prevent the foam pad 1600 from slipping off even if both pieces are subjected to a centripetal force by swinging in an arc at the speed to which the head of a golf club is ordinarily subjected.

Figure 17:
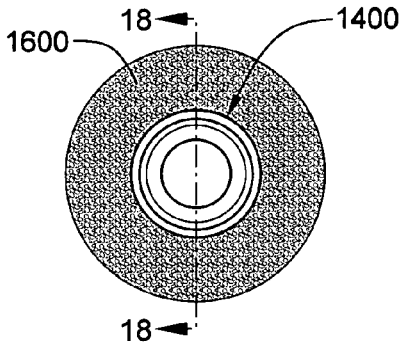
FIG. 17 is a top plan view of the tubular member of FIGS. 14 and 15 after installation in the cylindrical foam pad of FIG. 16.

Referring now to FIG. 17, the second embodiment tubular member 1400 is shown installed within the second embodiment resilient foam pad 1600 in a top view.

Figure 18:
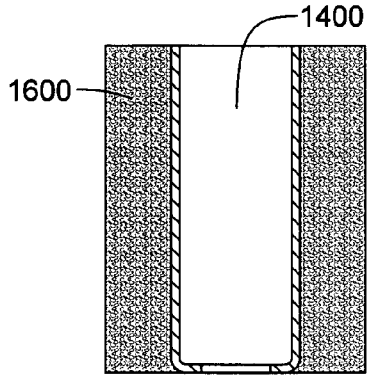
FIG. 18 is a cross sectional view of the assembly of FIG. 17, taken through section line 18-18.

Referring now to FIG. 18, this cross-sectional view shows the second embodiment tubular member installed within the second embodiment foam pad 1600.

Figure 19:
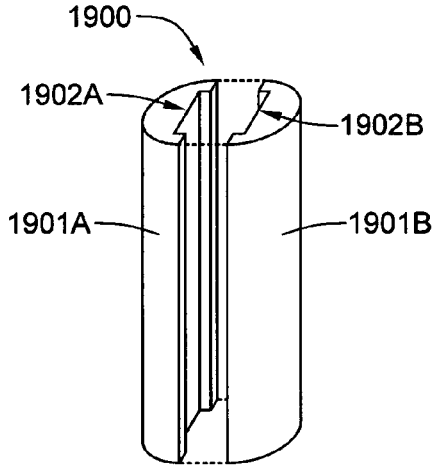
FIG. 19 is an isometric view of a pair of half inserts that can be installed within the tubular member of FIGS. 14 and 15.

Referring now to FIG. 19, a weighted cylindrical insert 1900 is split axially and longitudinally into two identical half inserts 1901A and 1901B. Each half insert 1901A and 1901B is equipped with a longitudinal groove 1902A and 1902B, respectively, so that the flexible strap 600 can be trapped between the two half inserts 1901A and 1901B when the grooves 1902A and 1902B are mutually aligned and the two half inserts 1901A and 1901B are brought together in intimate contact. The depth of each groove is at least the thickness of the flexible nylon strap 600 to account for the double-thickness, sewn-together region 702 used to secure the retainer plate 400. The weighted cylindrical insert 1900 is installable within the second embodiment tubular member 1400 so that the weight of the assembly can be adjusted to a desired value which simulates a particular golf club head. Multiple inserts of different weights can be supplied. In addition, half inserts of different materials may be combined in order to adjust the weight in smaller increments. The weighted cylindrical insert 1900 can be fabricated from a variety of materials, including metals (aluminum, magnesium, iron, steel, brass, etc.), wood of different types and densities, different polymeric plastic materials. The weight of each of the half inserts an be varied by forming voids therein either by drilling, casting, or injection molding (in the case of plastics). If the clearances between the insert 1900 and the second embodiment tubular member 1400 are minimal, there is no need for a retaining device to prevent the insert 1900 from falling out the top of the tubular member 1400. However, the insert 1900 can be positively secured within the tubular member 1400 by placing a sliding friction sleeve around the flexible nylon strap 600, sliding it up to install the insert 1900 and then sliding it down on top of the insert 1900. Alternatively, a double layer compression pad can be placed on one side of the flexible nylon strap 600 above the double thickness region 702, between the two half inserts 1901A and 1901B. The double layer compression pad can, for example, have a smooth laminar polyethylene or polypropylene facing the strap 600 that is backed by a compressible foam layer made of a material such as neoprene foam. When compressed, the polyethylene or polypropylene layer will slide against the strap, but the compressible foam layer will remain stationary with respect to the half insert 1901A or 1901B which it contacts.

Figure 20:
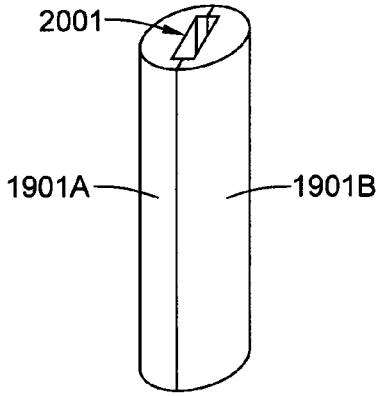
FIG. 20 is an isometric view of the pair of the half inserts of FIG. 19 after they are brought together.

Referring now to FIG. 20, the half inserts 1901A and 1901B have been brought together, leaving an aperture 2001 of rectangular cross section having a minor dimension 2002 that is, ideally, double the thickness of the nylon strap 600 and a major dimension 2003 that is equal the width of the nylon strap.

Figure 21:
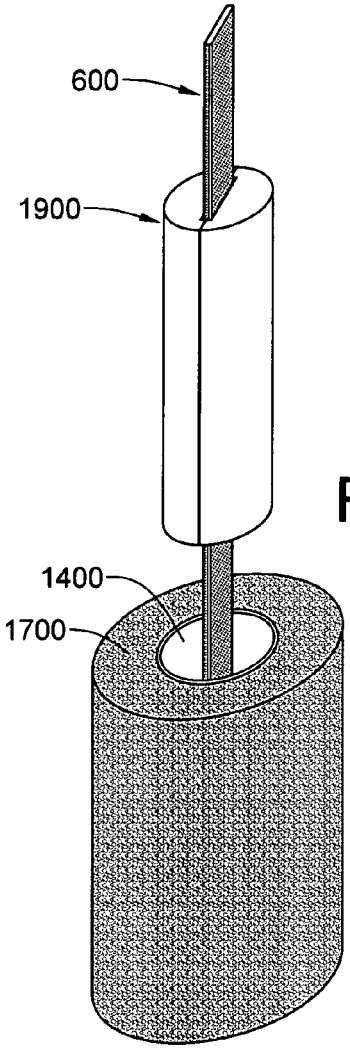
FIG. 21 is an isometric side/top view of the half inserts of FIG. 19 ready for installation in the tubular member of FIGS. 14 and 15 after the strap is placed in the slot between them.

Referring now to FIG. 21, the insert 1900 is ready for installation in the second embodiment tubular member 1400 that has been installed in the second embodiment resilient foam pad 1700. It is, of course, understood that the second embodiment golf swing trainer also comprises the flaccid, three layer towel strip 300, to which the upper end of the flexible nylon strap 600 is attached along the bottom edge.

Figure 22:
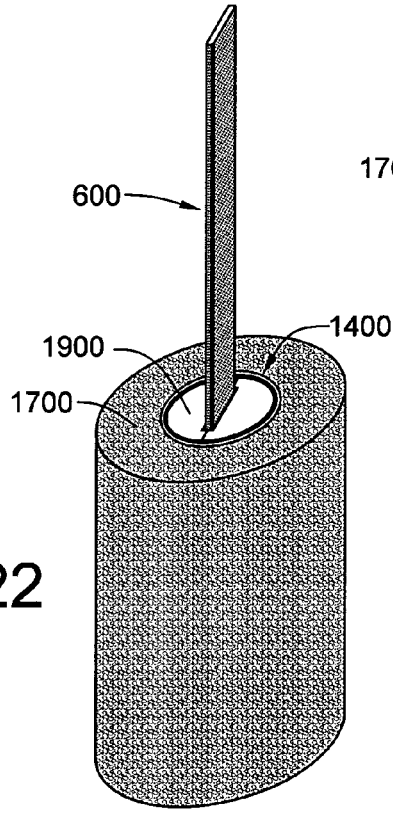
FIG. 22 is an isometric view side/top view of the assembly of FIG. 21 after the half inserts are installed in the alternative embodiment tubular member.

Referring now to FIG. 22, the insert 1900 has been installed in the second embodiment tubular member 1400 by sliding the former down the flexible nylon strap 600, resulting in a weighted head assembly 2200.

Figure 23:
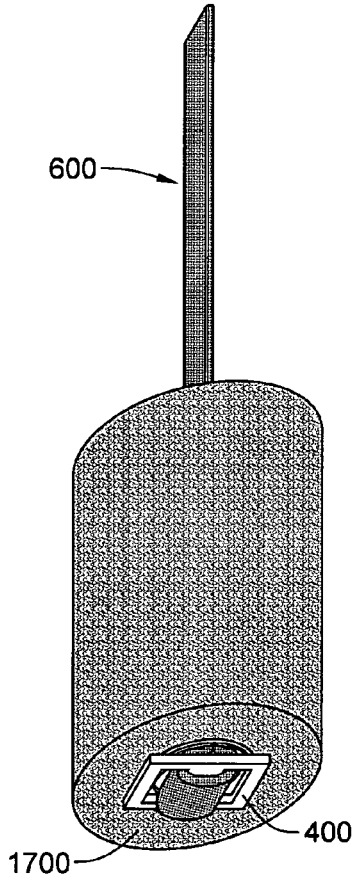
FIG. 23 is an isometric side/bottom view of the assembly of FIG. 21 after the half inserts are installed in the alternative embodiment tubular member.

Referring now to FIG. 23, the weighted head assembly 2200 is seen from below. It will be noted how the retainer plate 400 secures the strap 600 to the assembly 2200.

The golf swing trainer can be used to improve the motion, path accuracy, and timing of the golf swing, as well as optimum positioning of the hands at the top of the backswing and followthrough. In order to achieve these goals, the golf swing trainee grasps the free end of the towel strip 300 as though it were the grip at the top of the golf club shaft, using a conventional golf club grip, with both hands wrapped around the strip 300, with the right hand below the left hand for a right-handed swing. In order to improve the execution of the full motion golf swing, the weight is swung slightly forward before the backswing is begun. When the trainee feels the padded weight assembly 1100 or 2200 tap his left shoulder at the top of the backswing, he knows that his hands are optimally positioned to begin the downswing. From the standpoint of swing timing, he should begin the downswing with no delay as soon as he feels the tap on his left shoulder. Maximum velocity of the padded weight assembly should be achieved at the very bottom of the downswing, which is the point where the club head should impact the ball. The trainee should be able to ascertain the moment of maximum speed, as maximum speed will equate with maximum sound levels as the towel strip 300 and padded weight assembly 1100 or 2200 move through the air. During the downswing, the trainee should also note the path of the padded weight assembly 1100 or 2200 and adjust it so that it is perpendicular to his stance. During the followthrough, the padded weight assembly 1100 or 2200 should tap the right shoulder. Used in this manner, the golf swing trainer of the present invention will assist the trainee in developing a powerful, properly-timed, fluid swing having consistent directional stability.

Although only several embodiments of the new golf swing trainer has been described herein, it should be obvious to those having ordinary skill in the art that changes and modifications may be made thereto without departing from the scope and the spirit of the invention as hereinafter claimed. For example, it should be clear that a weighted insert may be used in combination with the first embodiment tubular member 900. However, the second embodiment tubular member 1400 is of larger diameter and weighs less. Therefore, it is possible to provide a simulated club head having both more or less total weight using the second embodiment tubular member 900, as the weighted insert 1900 will have a greater effect on the total weight of the assembly. For example, a lightweight ribbed plastic insert may be used for minimal weight increase, while an iron or brass insert may be used for maximum weight increase.

What is claimed is:

1. A golf swing trainer comprising:

a towel folded parallel to its longitudinal edges to form a flaccid multi-layer strip which simulates the handle and shaft of a golf club;

a flexible strap having first and second ends, said first end being sewn to a bottom edge of said strip with stitching, said stitching also serving to hold together multiple folded layers of said towel;

a weighted tubular member connected to the second end of said flexible strap, said weighted tubular member simulating the head of a golf club; and a retainer plate having two apertures separated by a bar that is integral with the plate, and a second end of said strap is looped around the bar and sewn to a region on one of two major surfaces of the strap, said region being spaced from the second end, said retainer plate being rotatable within the looped end of the strap so as to pass through said tubular member when the retainer plate is generally parallel to the major surfaces of the strap and not pass through said tubular member when perpendicular to the major surfaces.

2. The golf swing trainer of claim 1, which further comprises a resilient pad which surrounds said tubular member.

3. The golf swing trainer of claim 1, which further comprises at least one insert which is split axially and longitudinally into two half inserts, each half insert having a longitudinal groove so that the flexible strap can be trapped between the two half inserts when the grooves are mutually aligned and the two half inserts are brought together in intimate contact, said insert installable within said tubular member to adjust said weight to a desired value.

4. The golf swing trainer of claim 3, wherein said generally cylindrical insert is made from a material selected from the group consisting of injection-molded polymeric plastics, rubber, wood and metals.

5. A golf swing trainer comprising:

a towel folded parallel to its longitudinal edges to form a flaccid multi-layer strip which simulates the handle and shaft of a golf club;

a tubular member;

a flexible strap which interconnects the bottom edge of the strip and said tubular member; and at least one insert which is split axially and longitudinally into two half inserts, each half insert having a longitudinal groove so that the flexible strap can be trapped between the two half inserts when the grooves are mutually aligned and the two half inserts are brought together in intimate contact, said at least one insert being individually installable within said tubular member to adjust said weight to a desired value;

wherein said tubular member, alone or in combination with an insert, simulates the head of a golf club.

6. The golf swing trainer of claim 5, wherein said generally cylindrical insert is made from a material selected from the group consisting of injection-molded polymeric plastics, rubber, wood and metals.

7. The golf swing trainer of claim 5, wherein a first end of said strap is sewn to the bottom edge of the strip with stitching, said stitching also serving to hold together multiple folded layers of said towel.

8. The golf swing trainer of claim 5, which further comprises a resilient pad which surrounds said tubular member.

9. The golf swing trainer of claim 5, wherein said tubular member is generally cylindrical having an axis which passes generally through said strap.

10. The golf swing trainer of claim 5, which further comprises a retainer plate having two apertures separated by a bar that is integral with the plate, and a second end of said strap is looped around the bar and sewn to a region on one of two major surfaces of the strap, said region being spaced from the second end, said retainer plate being rotatable within the looped end of the strap so as to pass through said tubular member when the retainer plate is generally parallel to the major surfaces of the strap and not pass through said tubular member when perpendicular to the major surfaces.

11. The golf swing trainer of claim 5, wherein each of said longitudinal grooves has a depth at least equal to the thickness of said strap.

12. A golf swing trainer comprising:

a towel folded parallel to its longitudinal edges to form a flaccid multi-layer strip which simulates the handle and shaft of a golf club;

a generally cylindrical resilient foam pad having a central cylindrical aperture;

a tubular member installed within the central cylindrical aperture, said tubular member and said foam pad simulating the head of a golf club;

a flexible strap having first and second ends, said first end being sewn to a bottom edge of said strip and said second end passing through said tubular member and being anchored to a lower end thereof.

13. The golf swing trainer of claim 12, wherein stitching by means of which said first end is sewn to the bottom edge of said strip also serves to hold together multiple folded layers of said towel.

14. The golf swing trainer of claim 12, which further comprises a retainer plate having two apertures separated by a bar that is integral with the plate, and a second end of said strap is looped around the bar and sewn to a region on one of two major surfaces of the strap, said region being spaced from the second end, said retainer plate being rotatable within the looped end of the strap so as to pass through said tubular member when the retainer plate is generally parallel to the major surfaces of the strap and not pass through said tubular member when perpendicular to the major surfaces.

15. The golf swing trainer of claim 12, which further comprises at least one insert which is split axially and longitudinally into two half inserts, each half insert having a longitudinal groove so that the flexible strap can be trapped between the two half inserts when the grooves are mutually aligned and the two half inserts are brought together in intimate contact, said insert installable within said tubular member to add weight to said tubular member and said resilient pad.

16. The golf swing trainer of claim 15, wherein said generally cylindrical insert is made from a material selected from the group consisting of injection-molded polymeric plastics, rubber, wood and metals.

17. The golf swing trainer of claim 15, wherein each of said longitudinal grooves has a depth at least equal to the thickness of said strap.

* * * * *